US008966983B2

(12) United States Patent
Schoen

(10) Patent No.: US 8,966,983 B2
(45) **Date of Patent: *Mar. 3, 2015**

(54) METHOD AND DEVICE FOR THE DETECTION OF RECORDING MEDIA

(75) Inventor: Dierk Schoen, Egelsbach (DE)

(73) Assignee: Pepperl + Fuchs GmbH, Mannheim (DE)

( * ) Notice: Subject to any disclaimer, the term of this patent is extended or adjusted under 35 U.S.C. 154(b) by 352 days.

This patent is subject to a terminal disclaimer.

(21) Appl. No.: 13/558,438

(22) Filed: Jul. 26, 2012

(65) Prior Publication Data

US 2013/0152689 A1 Jun. 20, 2013

Related U.S. Application Data

(63) Continuation of application No. 11/422,682, filed on Jun. 7, 2006, now Pat. No. 8,266,965.

(30) Foreign Application Priority Data

Jun. 7, 2005 (DE) ..... 10 2005 026 200

(51) Int. Cl.
*B65H 7/04* (2006.01)
*B65H 7/12* (2006.01)

(52) U.S. Cl.
CPC ..... *B65H 7/04* (2013.01); *B65H 7/125* (2013.01); *B65H 2553/22* (2013.01); *B65H 2553/23* (2013.01); *B65H 2553/30* (2013.01); *B65H 2553/412* (2013.01); *B65H 2557/242* (2013.01)
USPC ..... 73/598; 73/572; 73/600; 73/661; 271/258.01; 271/259

(58) Field of Classification Search
USPC ..... 73/572, 598, 600, 601, 649, 661; 271/258.01, 258.02, 258.03, 258.04, 271/259, 260, 261, 262, 265.01, 265.02, 271/265.03, 265.04
See application file for complete search history.

(56) References Cited

U.S. PATENT DOCUMENTS

| | | | |
|---|---|---|---|
| 3,771,117 | A | 11/1973 | Shaffer et al. |
| 3,961,323 | A | 6/1976 | Hartkorn |
| 4,066,969 | A | 1/1978 | Pearce et al. |
| 4,114,457 | A | 9/1978 | Thun |
| 4,201,093 | A | 5/1980 | Logan |
| 4,368,438 | A | 1/1983 | Stienstra |
| 4,424,715 | A | 1/1984 | Hansen |

(Continued)

FOREIGN PATENT DOCUMENTS

| | | | |
|---|---|---|---|
| DE | 2629562 | A1 | 11/1977 |
| DE | 3025788 | A1 | 1/1982 |

(Continued)

OTHER PUBLICATIONS

USPTO Office Action, U.S. Appl. No. 11/422,682, Notification Date Jan. 12, 2010, 17 pages.

(Continued)

*Primary Examiner* — David A Rogers
(74) *Attorney, Agent, or Firm* — John A. Merecki; Hoffman Warnick LLC

(57) ABSTRACT

The invention relates to a method and a device for the contactless detection of laminated, flat objects, particularly sheet-like recording media. There is a galvanic separation and mechanical decoupling between the transmitter and receiver to improve detection. These measures can be further improved with correction characteristic methods.

37 Claims, 10 Drawing Sheets

(56) References Cited

U.S. PATENT DOCUMENTS

| | | | | |
|---|---|---|---|---|
| 4,446,735 | A | 5/1984 | Weilacher | |
| 4,462,587 | A | 7/1984 | Graef et al. | |
| 4,643,089 | A * | 2/1987 | Salazar et al. | 101/91 |
| 5,023,846 | A | 6/1991 | Busch-Sorensen | |
| 5,026,035 | A | 6/1991 | Martinez Sanz et al. | |
| 5,274,242 | A | 12/1993 | Dragon et al. | |
| 5,279,403 | A | 1/1994 | Harbaugh et al. | |
| 5,373,482 | A | 12/1994 | Gauthier | |
| 5,661,243 | A | 8/1997 | Bryan et al. | |
| 5,697,248 | A | 12/1997 | Brown | |
| 6,082,732 | A | 7/2000 | Hutchison et al. | |
| 6,212,130 | B1 | 4/2001 | Brazeal, Jr. et al. | |
| 6,281,679 | B1 | 8/2001 | King et al. | |
| 6,314,054 | B1 | 11/2001 | Priebsch | |
| 6,407,599 | B1 | 6/2002 | Phinney et al. | |
| 6,511,064 | B1 | 1/2003 | Phinney et al. | |
| 6,918,587 | B2 | 7/2005 | Duncan et al. | |
| 7,025,348 | B2 | 4/2006 | Phinney et al. | |
| 7,130,245 | B2 | 10/2006 | Okitsu et al. | |
| 7,172,195 | B2 | 2/2007 | Sano et al. | |
| 7,270,325 | B2 | 9/2007 | Sano et al. | |
| 7,437,960 | B2 | 10/2008 | Priebsch | |
| 7,726,214 | B2 | 6/2010 | Schoen | |
| 2002/0062681 | A1 | 5/2002 | Livingston | |
| 2004/0100018 | A1 | 5/2004 | Phinney et al. | |
| 2005/0224731 | A1 | 10/2005 | Hahn et al. | |
| 2005/0236758 | A1 | 10/2005 | Ohgita et al. | |
| 2006/0177117 | A1 | 8/2006 | Morisaki et al. | |
| 2008/0224390 | A1 | 9/2008 | Ma et al. | |

FOREIGN PATENT DOCUMENTS

| | | | | |
|---|---|---|---|---|
| DE | 3048710 | A1 | 7/1982 | |
| DE | 3236017 | A1 | 3/1984 | |
| DE | 3620042 | | 1/1987 | |
| DE | 4022325 | A1 | 1/1992 | |
| DE | 4233855 | A1 | 4/1994 | |
| DE | 4403011 | C1 | 2/1995 | |
| DE | 19521159 | A1 | 12/1996 | |
| DE | 19613311 | A1 | 9/1997 | |
| DE | 19701644 | A1 | 7/1998 | |
| DE | 29722715 | U1 | 4/1999 | |
| DE | 19921217 | | 11/2000 | |
| DE | 19921217 | A1 | 11/2000 | |
| DE | 19927865 | A1 | 1/2001 | |
| DE | 10216742 | A1 | 11/2002 | |
| DE | 20312388 | U1 | 11/2003 | |
| DE | 10233052 | | 2/2004 | |
| DE | 202004006285 | U1 | 7/2004 | |
| DE | 10327389 | B3 | 12/2004 | |
| DE | 102004056742 | A1 | 9/2005 | |
| EP | 0997747 | A2 | 5/2000 | |
| EP | 1067053 | | 1/2001 | |
| EP | 1201582 | A2 | 5/2002 | |
| EP | 1617337 | A2 * | 1/2006 | |
| JP | 2000172897 | A | 6/2000 | |
| WO | WO 2004049281 | A2 * | 6/2004 | G08C 17/00 |
| WO | 2005066051 | A1 | 7/2005 | |

OTHER PUBLICATIONS

USPTO Final Office Action, U.S. Appl. No. 11/422,682, Notification Date Aug. 31, 2010, 11 pages.

USPTO Office Action, U.S. Appl. No. 11/422,682, Notification Date Mar. 18, 2011, 13 pages.

USPTO Final Office Action, U.S. Appl. No. 11/422,682, Notification Date Dec. 19, 2011, 9 pages.

USPTO Notice of Allowance and Fee(s) Due, U.S. Appl. No. 11/422,682, Date Mailed Jul. 16, 2012, 6 pages.

* cited by examiner

METHOD AND DEVICE FOR THE DETECTION OF RECORDING MEDIA

CROSS-REFERENCE TO RELATED APPLICATIONS

This patent application is a continuation application of U.S. patent application Ser. No. 11/422,682, filed on Jun. 7, 2006 now U.S. Pat. No. 8,266,965, which is incorporated herein in its entirety by reference.

FIELD OF THE INVENTION

The invention relates to a method and device for the contactless detection of laminated, flat objects, particularly sheet-like recording media or record supports.

BACKGROUND OF THE INVENTION

The concept of a sheet-like recording medium is to be understood very widely in the present application. On the one hand it covers papers used in office equipment such as scanners, printers, copiers, as well as in cash separators and printing presses. On the other it covers the sphere of adhesively interconnected, laminated materials, particularly labels, splice, break or tear-off points. The term recording medium is also implied as covering foils and banknotes.

When processing such recording media or the corresponding laminated, flat objects in copiers or separating equipment, such as automatic teller machines, there is an absolute need for an individual supply of the recording media present in stacks for the purpose of further processing or discharge. Despite the high reliability of mechanical separating systems, a problem constantly arises of multiple withdrawals or no withdrawal. Therefore it is vital to avoid or at least detect multiple, double or missing sheets of such recording media.

The present application also considers flat objects to cover objects present in sheet form, such as paper, films, foils, plates, corrugated boards and other such materials or packs and multiply laminated materials adhesively applied to a base or support material, for example, labels, splice, break or tear-off points and the like.

As a corresponding method for the contactless detection of the recording media with a view to there being a separation or a single sheet is also to be usable over a wide gram weight or weight per unit area range of such recording media, significant problems arise in being able to very reliably implement this from technical and economic standpoints.

DE 36 20 042 A1 discloses a method and a device of the aforementioned type. In order to be able to achieve the high security and reliability in connection with detection and the corresponding information provided to the effect that there has been a separation of the corresponding recording medium and no multiple or missing sheet exists, the known device makes use of two sensor devices with in each case two transducers. When using ultrasonics there is both an amplitude evaluation and a phase evaluation. In this device the acting disturbance variables or the drift of the ultrasonic frequency are detected by the use of a second ultrasonic comparison measuring section and in a comparison circuit difference values are formed with the corresponding measuring values, which are taken into account in the detection statement. In the case of different paper weights a learning stage is firstly necessary.

Admittedly in this way the known method and device can take account of disturbance variables such as transducer drift, temperature drift, and transit time changes through ambient temperature. However, the detectable gram weights are in a relatively narrow range of, for example, 35 to 400 g/m$^2$.

The known device and method are technically very complicated, without achieving a relatively high flexibility relative to a broad gram weight spectrum. Other methods and devices for detecting single sheets are, for example, known from DE 199 21 217 A1 and EP 1 067 053 A1. These ultrasonically based devices use sensor devices with a forked structure. For detecting labels it is necessary to have a preceding learning step, i.e., with respect to the label thicknesses expected in the detection process, so as to be able to pre-establish the corresponding specific signal values and ranges. These known devices have an excessively complex construction and can be strongly influenced by disturbance variables.

The detection of separated banknotes as disclosed, for example, in DE 102 33 052 A1 is also relatively complicated. It is assumed that radiation emanating from the banknote or recording medium is detected in at least two areas. If the banknote is present in multiple form, the measuring signal obtained through the radiation is significantly modified and attenuated, so that a detection criterion can be derived therefrom.

SUMMARY OF THE INVENTION

Therefore an object of the invention is to improve a method and a device of the aforementioned type to obtain the best possible security relative to the detection of multiple or single sheets or the separation of recording media or the most varied flat objects, over a broad spectrum of weights per unit area or a broad spectrum of the most varied flat objects.

It is consequently an essential principle of the invention to separate the sensor device or devices, for example, according to the sound principle, particularly the ultrasonic principle, with transmitter and receiver such that on the transmitter side there is a complete galvanic separation from the receiver side and additionally transmitter and receiver are mechanically decoupled from one another.

The transmitter and receiver are arranged in electrically completely separated manner and are placed on separate modules adjacent to the detection gap, in which normally the recording media are passed between the transmitter and receiver. This means that even the supply of the transmitter and receiver can be implemented separately, particularly, for example, using two separate power packs.

Thus, in a simple manner, this ensures that the transmitting energy can be coupled into a receiver tuned to the transmitting frequency by means of freely wired and/or lines applied to printed circuit boards or by a potential rise on the same circuit board.

With the receiver, unwanted signals with the same frequency as the useful signal are therefore completely avoided. Therefore, there is a rise in the ratio of the unwanted signal to the useful signal and consequently the receiver sensitivity can be increased.

Whereas hitherto it was possible to detect recording media with gram weights in a range of 100 to approximately 4000 g/m$^2$, it is in this way possible, particularly when using a characteristic correction method (according to P 10 2004 056 742.5) to extend this significantly without any learning process and to arrive at a range around approximately 6000 g/m$^2$ or the attenuation constant adequate for this. It is additionally possible in this way to detect simplex and even duplex corrugated boards.

A learning process on a recording medium or a separated flat object can be provided in the equipment in combination with the correction characteristic method in order to extend the material spectrum to be detected. The receiver sensitivity increase can, for example, be brought about by an increased gain in the input signal amplifier of the receiver.

The sensor device used according to the invention can in principle be of different sensor action types and can function optically, electromagnetically, inductively or capacitively or a combination of these action principles. The vital point is the separation of transmitter and receiver, where there is an at least galvanic signal separation, even in the case of a supply from a joint power pack. An ultrasonically based sensor device is referred to as the preferred example in this application.

A further important idea of the invention is that one sensor device with in each case one transducer as transmitter and receiver is sufficient in order to ensure the high detection security and reliability, i.e., it can, for example, be unnecessary to have reference measuring sections. It is consequently adequate to have a unidirectional measuring section with only one transducer pair between which the corresponding recording media can be passed with a view to the detection of multiple, missing or separated sheets. Consequently the disturbance level in the receiver can be significantly reduced by the preceding, aforementioned measures. Therefore, significant economic advantages are obtained without any need for complicated, expensive comparison measuring sections or other compensating methods.

It is also possible to connect in parallel several such sensor devices with and without a corresponding, standard synchronization of the individual sensors in order to, for example, bring about a quality control of the measuring material with a very broad spectrum of the latter. This method can, for example, be used with wide, laminated paper webs for detecting cavities or delamination on the paper web or any other flat objects or materials, in order to ensure, for example, the product quality of said materials.

In the present application and in connection with an ultrasonic sensor, the term transducer is understood to mean that there is a transducer element operating according to the given physical principle which, together with the necessary mechanical fixing elements, forms the joint electromechanical module "transducer".

Thus, in the case of the ultrasonic transducer there is an exciting or receiving piezoelectric layer and optionally a corresponding metal ring for improving the transducer characteristics. In the radiation direction a coupling out layer is then provided, which in an optimum manner adapts the characteristic impedance of the piezoelectric ceramic to the characteristic impedance of air. The transducer element and coupling out layer are received in a transducer receptacle, which is foam filled, the latter measure also serving to attenuate the transducer. For shielding the transducer element and also for mechanically fixing the transducer, a transducer shielding can is provided to the outside and once again functions with the outer transducer receptacle as a mechanical receptacle or casing for the transmitter/receiver.

For the electromagnetic sensor, particularly the optical sensor, this means that use can be made as transducer elements of, for example, phototransistors and photodiodes or other such electromagnetic radiation transmitters and receivers.

Thus, the measures according to the invention make it possible to avoid fault-prone cable connections between transmitter and receiver. More specifically in the fold-up or pop-up modules and elements of office machines or sheet-like recording media-processing or working machines, such as printing units, copiers, automatic teller machines and the like, servicing work can be more easily performed, because there can be no damage to the connecting lines between transmitter and receiver.

It is appropriate not only to completely separate the signal connections between transmitter and receiver, but instead to provide a completely separate voltage and current supply between transmitter and receiver, to exclude electronic interactions of the transmitter on the receiver and the evaluation thereof. The prerequisite for this is the spatial separation of transmitter and receiver.

It is particularly advantageous to combine the inventive measures (according to P10 2004 056 742.5) from the method and device standpoint with characteristic correction measures. In the case of flat materials, for example, sheet-like recording media and papers, a specific correction characteristic is impressed on the measuring characteristic received to obtain a target characteristic, which is close to an ideal signal course for optimum evaluation. This is used in the same way with multilaminated materials adhesively applied to base or support materials and which are exemplified by labels. Here again use is made of a correction characteristic leading to a target characteristic with a different structure and by means of which it is possible to achieve a clear detection regarding the presence or absence of a label. It is also possible to combine both methods and implement the same within a single device.

Appropriately the transmitting signal undergoes at least one frequency modulation, so that no standing waves can arise in transmission operation between the recording media and the receiver.

In a particularly advantageous variant of the invention the frequency modulation can also be used for compensating transducer ageing effects, so that the amplitude maximum used should always be in the frequency range covered.

Another advantage of frequency modulation in the invention is that transducer tolerances of the sensor elements can be automatically corrected in operation by frequency modulation. As the transducer pairs generally have different resonant frequencies, through a frequency sweep fs the resonance maximum is periodically exceeded. If the device response time is well below 1/fs, it is possible to make optimum use for sound transmission purposes of the property of each individual transducer or transducer pair.

It has also proved advantageous that the sensor device can be switched from pulsed operation to continuous operation by circuitry or in program-controlled manner on the transmitter. In continuous operation, in order to avoid standing waves, phase jumps and/or brief pauses of the transmitting signal can be produced or use can be made of the aforementioned transmitting signal modulation.

According to the invention there is no need for transmitter synchronization by the receiver for continuous operation. In pulsed transmitter operation the receiver can be synchronized with the transmitter. Receiver synchronization to the transmitter can take place in a form of clock recovery, for example, by impulsing a PLL or by a synchronizing pulse, but this only constitutes a single example.

It is also possible to automatically correct transducer tolerances of ultrasonic sensors before and/or during operation. This leads to a standardization of the transducer pairs to a fixed value with a predetermined, fixed spacing, for example, the optimum assembly spacing. This leads to a correction factor which can then be filed in table form in the evaluating software and which is then used on switching on the device. It must also be borne in mind that through the use of, for example, a simple logarithmic correction characteristic a linearly falling target characteristic over the transducer spacing is produced, i.e., the input signal on a microprocessor present at the receiver output in good approximation falls linearly with the spacing with respect to the transducer. Therefore the correction of the values is easy, even in the case of a variable transducer spacing, because on switching on the sensor device only a line function must be calculated for the correct initial value.

The invention also offers the advantage that the spacing between transmitter and receiver with high detection security is not limited to a fixed spacing, but can instead be variable in accordance with requirements and applications. This more particularly applies for the use of sound, particularly ultrasonics, as well as for electromagnetic sensors, particularly optical sensors, where the transducer characteristics change over the service life.

More specifically in the case of the inventive use of transducers there is a high flexibility in the design of transmitter and receiver and the combination thereof. Thus, the transducer can be designed as a straight or angled transducer, the transducers with transducer receptacle can be placed in the casing, particularly a cylindrical or parallelepipedic casing, or have no equipment casing. Therefore, in a particularly simple and cost effective manner such transducers can be applied more particularly in plane-parallel or at a right angle to or on the support, which is normally a printed circuit board. Normally the supports carry the necessary electronics for the sensors to be formed. Therefore the transmitter and receiver can be combined as a transducer pair in the usual way and with different casings. It is important that there is an axial orientation of the radiation between transmitter and receiver. The thus formed sensor devices, which can combine separate transmitter and receiver have a casing completely enveloping the central modules transducer or transducer receptacle and printed circuit board, more especially in a sealing manner, or which has no casing.

These sensor devices can be used in equipment such as office machines, sheet-like recording media-processing machines, such as printing units, copiers, automatic teller machines, voting machines or the like. In a particularly economic manner the transducers mounted solely on a support can be incorporated into the flat material-processing machines, the machine casing protecting the sensor applied to a support.

This makes it possible to obviate the need in the case of sensor devices of the casing made expensive by the high manufacturing costs. Therefore the procedure according to the invention provides an economically efficient method of installing sensors, without significant technical disadvantages, in machines processing recording media.

BRIEF DESCRIPTION OF THE DRAWINGS

The invention is described in exemplified manner hereinafter relative to the attached drawings, wherein.

DETAILED DESCRIPTION OF THE INVENTION

Figure 1:
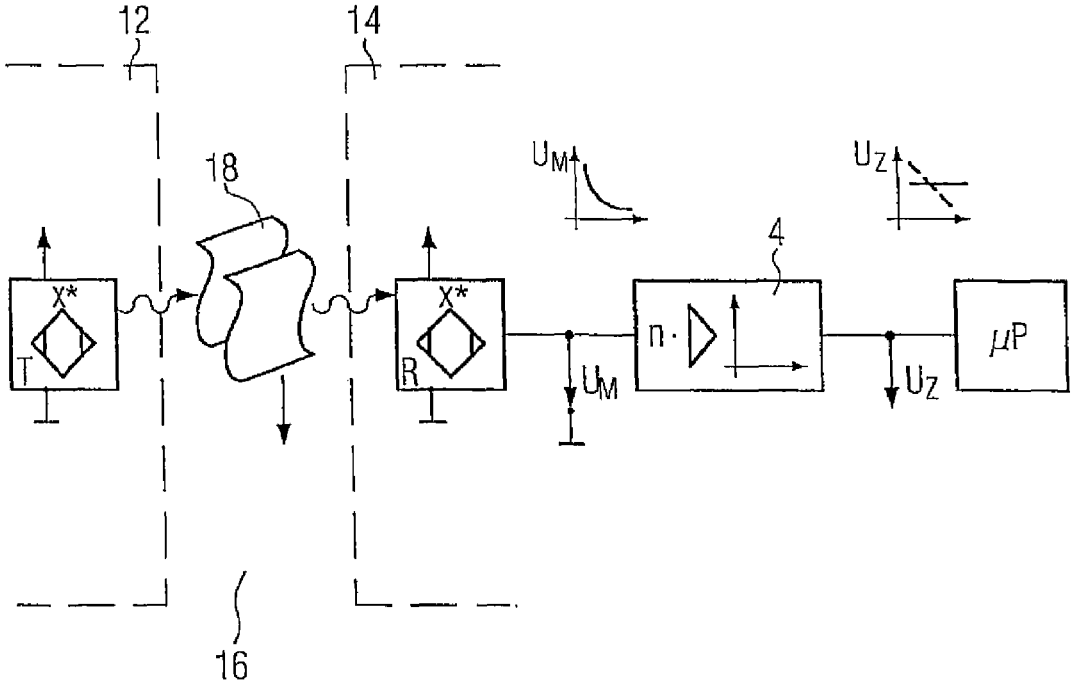
FIG. 1 Diagrammatically a sensor device with a transmitter galvanically and mechanically separated from the receiver.

FIG. 1 diagrammatically shows the fundamental principle of the invention. Transmitter T is electronically and mechanically separated from receiver R and there is a galvanic isolation between transmitter T and receiver R and a mechanical separation over different modules. In this way both electronic and electromagnetic disturbance and coupling effects, such as, for example, coupling capacitances/inductances, as well as vibration effects and the like are prevented between said essential components of a sensor device. Transmitter T is on a separate module 12, usually a separate printed circuit board, which is spaced at least by the width of the guidance gap 16 for the flat objects, recording media or measuring material 18 from module 14, which in preferred manner is in the form of a separate printed circuit board or receiver R.

Functionally the ultrasonic signal emitted, for example, by transmitter T is transmitted through the recording medium or media present and received in receiver R as measuring signal $U_M$. For further evaluation said measuring signal is supplied to a signal amplifier 4 with, for example, n signal paths and undergoes an evaluation with corresponding correction lines or characteristics.

The diagrammatic measuring value characteristic $U_M$ shown above signal amplifier 4 once again has a logarithmic or exponential or some other falling curve path over the gram weight range provided on the abscissa or the transmitting signal attenuation associated with the measuring material or recording medium. The correction characteristic or characteristics supplied to the signal amplifier 4 are impressed in such a way that in the case of detecting a single sheet, i.e., the presence or separation of a single recording medium, ideally produce at the output a target characteristic $U_Z$, which is shown diagrammatically and ideally has a constant line path without any gradient. Thus, ideally the voltage swing delta $U_Z$ tends to zero, so that over the entire gram weight range or the entire material spectrum of recording media there is a maximum voltage difference relative to a missing sheet or air or a double sheet present or for a randomly thick, separated recording medium there is always the same signal level. The real or actual circuit supplies an approximately linearly falling target characteristic $U_Z$ over the gram weight or the signal attenuation of the flat, separated material or recording medium correlating therewith.

This largely ideal target characteristic $U_Z$ is subsequently transmitted to a microprocessor μP for further evaluation and display, as to whether there is a separated recording medium or a double/multiple or missing sheet.

In place of the aforementioned ultrasonic sensor device, in principle it is possible to use or combine any other optically, electromagnetically, capacitively or inductively based sensor device. The criteria of an at least complete galvanic signal separation of both sides and mechanical decoupling must be respected.

Figure 2A:
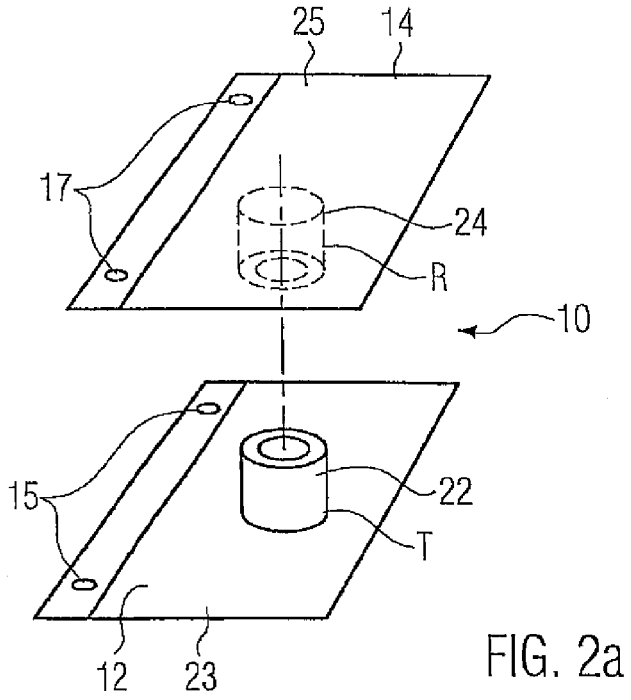
FIG. 2*a* The possibility of placing a cylindrical transmitter and a cylindrical receiver on different modules.

FIG. 2*a* shows in simplified form the possibility of arranging a sensor device. The transmitter T placed in the transducer receptacle as cylindrical transducer 22 is, for example, mounted directly on a lower printed circuit board 12, whose electronics have a separate voltage supply 23. In addition, said circuit board 12 is installed in spatially separated manner and separately via fastening 15 in a device.

A second printed circuit board 14 with a cylindrically designed transducer 24 of receiver R mounted directly thereon is positioned above and spaced by gap 16. This module also has a galvanically separated current supply 25 and is fastened by fastening 17 in mechanically decoupled manner with respect to the transmitter in a corresponding device.

Figure 2B:
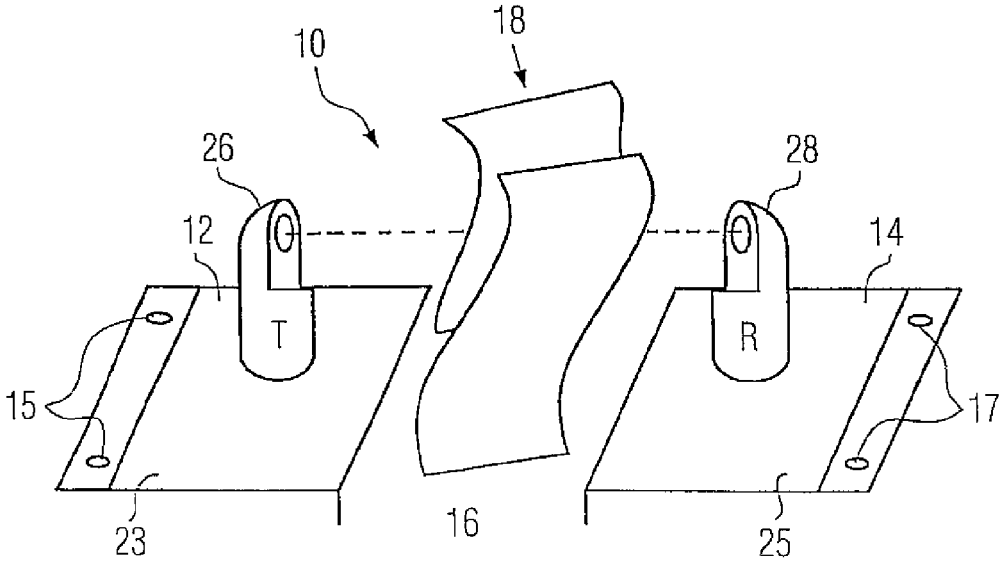
FIG. 2*b* A separated arrangement of transmitter and receiver with angled transducer and axial orientation in the radiation direction.

FIG. 2*b* shows the diagrammatic arrangement of an ultrasonic sensor device with angled transducers 26, 28. Transducers 26, 28 with their largely cylindrical casing, the transducer receptacle, are directly mounted on corresponding circuit boards 12 and 14, but are mechanically decoupled from one another. There is also a strict galvanic separation between the two electronic modules on circuit boards 12, 14. Transducers 26, 28 are oriented with their axial radiation direction to one another, so that a transmission signal with its amplitude maximum can be received.

Figure 3:
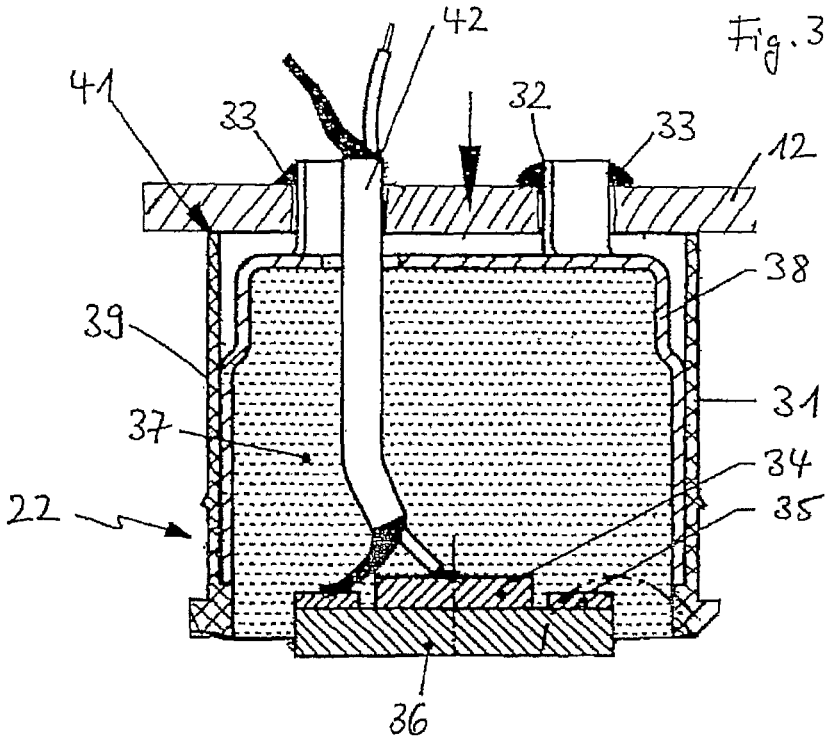
FIG. 3 A vertical section through an ultrasonic transducer with direct fitting to a printed circuit board.

FIG. 3 diagrammatically shows a vertical section through an ultrasonic transducer 22. The transducer 22 positively received in a cylindrical transducer receptacle 31 in a particularly advantageous variant is soldered 33 and fixed by means of strap-like bushings 32 directly to printed circuit board 12.

The sensor or piezoelectric element 34 is surrounded by an optionally usable, circumferential metal ring 35 and is fixed at the front and downwards to a coupling out layer 36. This fixing procedure is only one of the possibilities available for fixing the transducer to circuit board 12.

The transducer element 34 with coupling out layer 36 and shielded transducer cable 42 are secured, for example, by means of a polyurethane foam 37 within a shielding can 38. The shielding can 38 is positively received in the outer transducer receptacle 39, which in the direction of circuit board 12 has a planar, circumferential ring area 41, which is used for the planar orientation of the transducer and circuit board 12.

This ensures a very simple, inexpensive installation of the transducer directly on the circuit board and this also permits a precise orientation.

Figure 4:
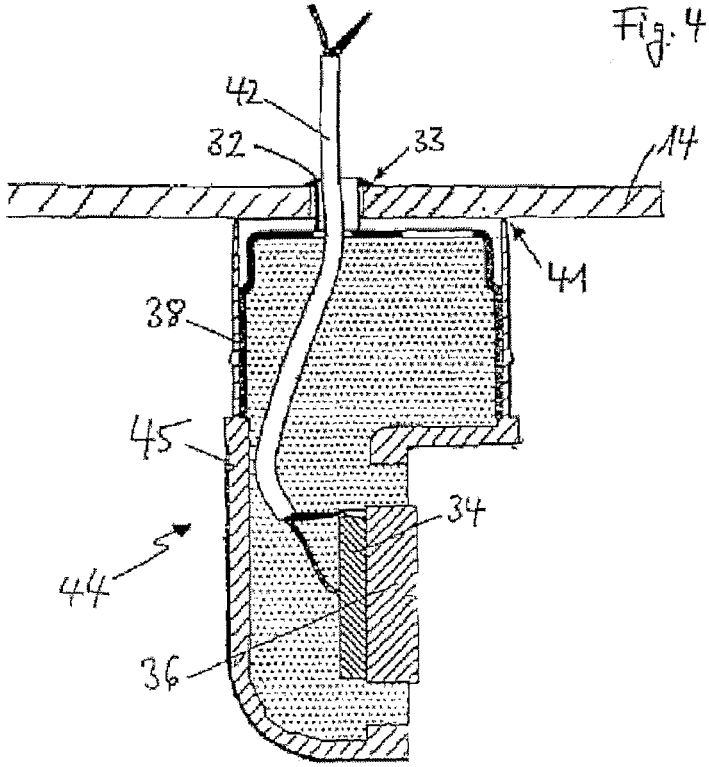
FIG. 4 A vertical section through another example of an angled ultrasonic transducer with direct fitting to a printed circuit board.

FIG. 4 shows a comparable example to that of FIG. 3, but using an angled or bent transducer. The same references mark the same elements as in FIG. 3. The angled transducer 44 according to FIG. 4 is directly soldered to a circuit board 14 and is oriented with respect to the latter with end regions 41. In this case there is a transducer casing 45 open in the axial direction of the transducer and parallel to the circuit board.

Figure 5:
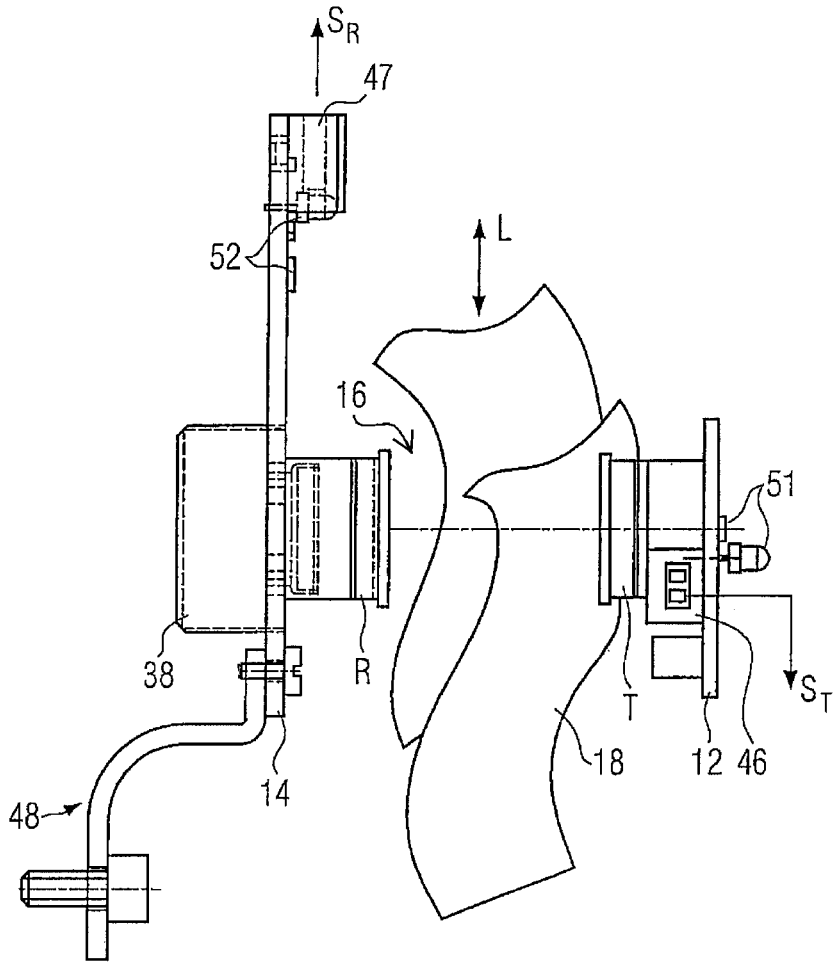
FIG. 5 A diagrammatic lateral view of an example of a sensor device with transmitter and receiver spaced by the recording medium guidance gap.

FIG. 5 is a lateral view of an embodiment of a sensor device with linkage to adjacent modules. Transmitter T and receiver R are oriented in the axial radiation direction facing gap 16 through which the recording media 18 are passed in direction L. There is a complete galvanic separation and mechanical decoupling between transmitter T and receiver R. Transmitter T is fixed to printed circuit board 12 and can be supplied by a separate current supply $S_T$ via at least one connector 46. The state of transmitter T can be displayed by means of at least one lighting means, for example, LEDs 51.

The receiver R, whose transducer can be fitted directly to circuit board 14 and which is electromagnetically shielded at the back by a shielding can 38, has a separate current supply $S_R$ via at least one connector 47. Mechanical fixing in the device takes place by means of a damping fastening clip 48.

The recording media shown in stylized form as double/multiple sheets 18 only constitute examples and there can obviously also be a separate sheet or no sheet in the sense of a missing sheet in gap 16.

Figure 6:
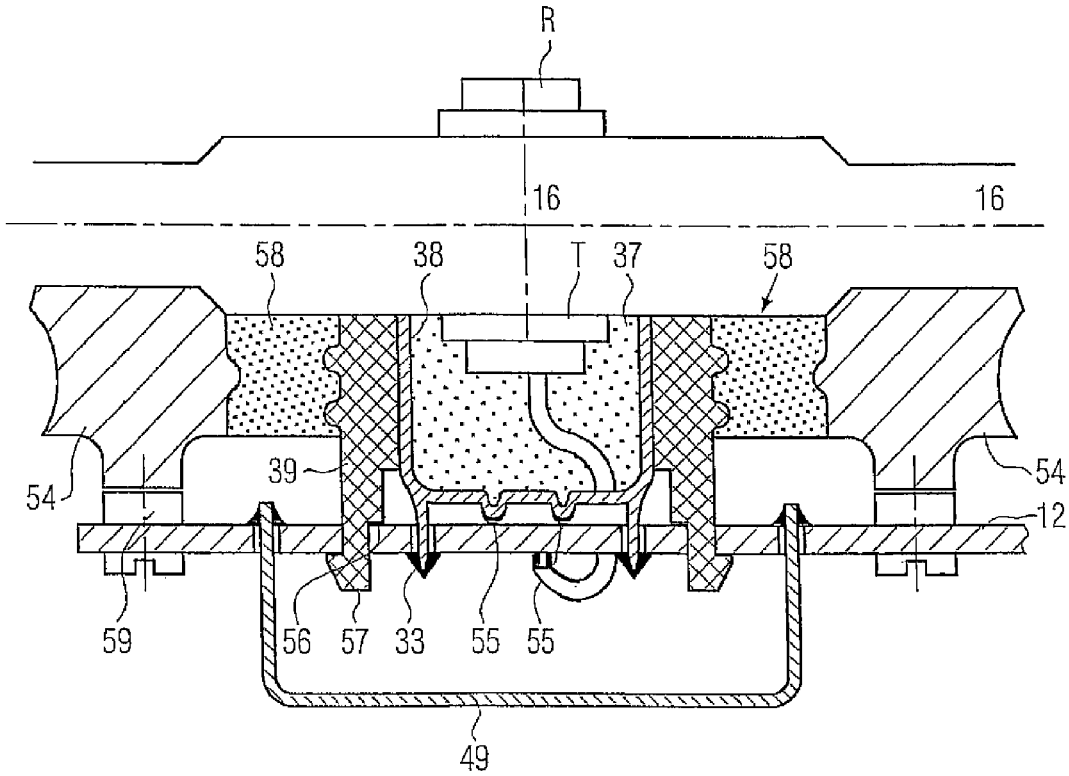
FIG. 6 A diagrammatic representation of a vertical section through transmitter and receiver on both sides of a horizontal guidance gap for the recording media, with shielding measures on the transmitter side.

FIG. 6 is a vertical section through an ultrasonic sensor device, in which are shown further details of the mechanical decoupling and electromagnetic shielding of the transmitter. It is also possible to see how a sensor device, without its own casing, can be installed in an office machine or sheet-like recording medium-processing or working machine, copier, automatic teller machine or voting machine and is integrated into the equipment casing 54 thereof. As a result the sensor unit is adequately protected against ambient influences.

In the present example the recording media are passed through a horizontally directed gap 16, where receiver R is shown in the upper area. The lower view relates to transmitter T with its linkage with surrounding modules forming part of the equipment casing 54.

In a largely positive manner the transducer with the shielding can 38 is received in the surrounding transducer receptacle 39, which at the bottom is provided with detents 57, which engage behind the support 12 as a circuit board. At the bottom the shielding can 38 has downwardly projecting studs 55 by means of which there can be an orientation of the transducer element with respect to the plane of circuit board 12. Thus, it is possible to easily orient the transmitter T by means of shielding can 38 with transducer receptacle 39 in plane-parallel manner to the circuit board 12, despite the direct installation thereon. Towards the bottom the terminals are electromagnetically encapsulated by the shielding can 49.

From the mechanical standpoint, for the positioning of the transducer T relative to the equipment casing 54 there is an annular, all-round rubber or elastomer connection 58 or a connection formed from some similar material, which brings about a vibration decoupling of the transducer or transducer receptacle 38 relative to the equipment casing 54. Circuit board 12 is also cushioned by a vibration damper 59, for example, a rubber washer, with respect to the casing 54. Thus, via transducer receptacle 39 and the circumferential edge 56, transducer T can still be oriented in plane-parallel manner with circuit board 12.

The alternatively provided deep-drawn studs 55 on the shielding can 38 can also be used for this purpose if circumstances do not allow a transducer receptacle 39.

The rubber connection 58 to the surrounding module of the equipment casing 54 has a vibration damping function and provides a dustproof termination of the equipment casing 54 with the sensor device. Normally circuit board 12 is connected in shape-stable manner to the equipment casing 54.

The presently described parts such as the shielding can of transducer 38, transducer receptacle 39, shielding can on circuit boards 49, elastomer connection 58, vibration damper 59 and the equipment casing 54 can have differing shapes and constructions, the important point for the present inventive use is the functionality described.

In this construction the invention also allows an arrangement of transmitter T and receiver R with a variable spacing, which can be adapted to the corresponding application.

Figure 7:
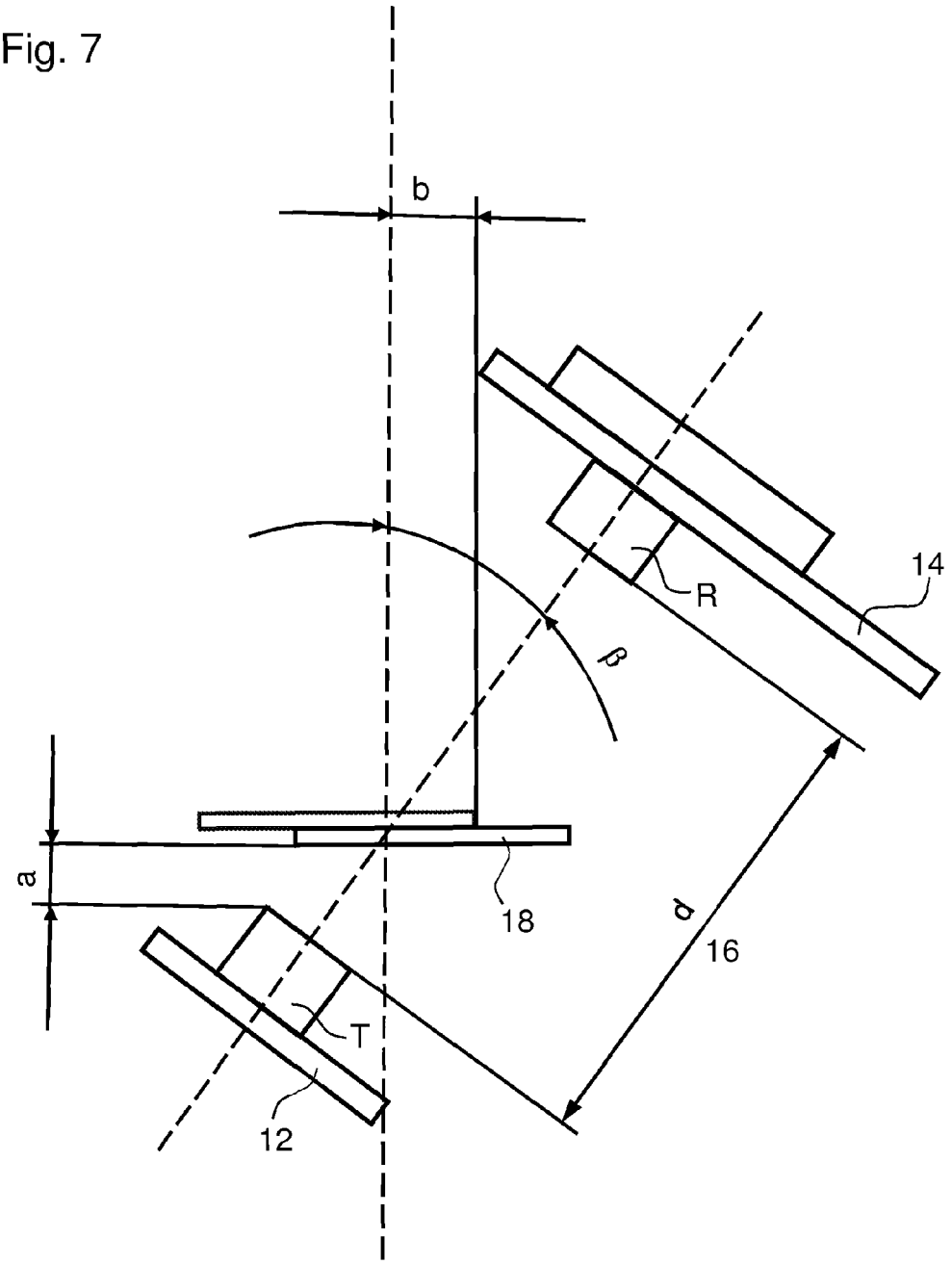
FIG. 7 A diagrammatic representation of a sensor device with a radiation axis inclined by an angle to a horizontal double sheet running direction.

FIG. 7 diagrammatically shows the orientation of transmitter T and receiver R in an intersection angle with the plane of recording medium 18. The inclined positioning of the radiation axis relative to the recording media also has the advantage of avoiding standing waves in continuous operation. The inclination angle is preferably in the range +/−45°.

The minimum spacing a between the transmitter edge and the lower recording medium edge should be approximately 5 to 10 mm. The minimum spacing b can be approximately 2 to 15 mm, particularly 10 mm. This spacing b is dependent on the selected multiple/double sheet threshold and the flat material. The heavier the paper, i.e., the higher the gram weight or the material damping corresponding thereto and the more it is necessary to reduce the multiple/double sheet threshold, the greater must be the spacing b. The spacing d is technically implementable roughly in the range 10 to 90 mm and is normally in the range 20 to 80 mm, the optimum being approximately 45 mm.

Figure 8A:
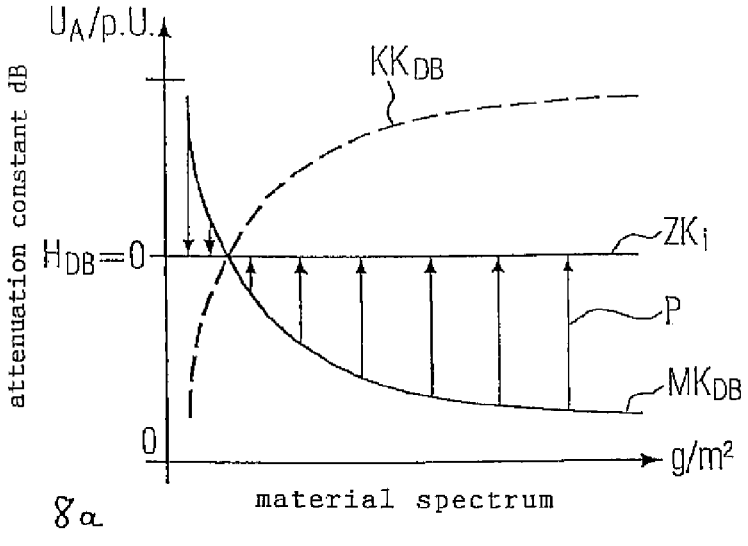
FIG. 8*a* A simplified view between a measuring value characteristic, correction characteristic and ideal target characteristic with a double sheet.

FIGS. 8*a, b, c* show in simplified form the curve paths based on measuring value characteristics MK subject to idealized correction characteristics KK, in order to obtain the sought target characteristic ZK for reliable detection in the fundamentally differing cases of a double sheet detection and/or a label detection.

Therefore a further essential concept of the present invention is to combine the improvements obtained through galvanic separation and mechanical decoupling of the transmitter side from the receiver side with the characteristic correction method, for example, according to P 10 2004 056 742.5.

The use of correction characteristics for improving the detection of recording media as multiple or separated sheets, is based on the fact that without the use thereof and an approximate linear amplification of the signal received on the receiver side and with further filtering and evaluation, as a function of the gram weight or weight per unit area or the material damping corresponding thereto, a characteristic for the amplified measuring signal is obtained, which is essentially strongly nonlinear, particularly exponential, multi-exponential, hyperbolic or has a similar falling path and over the wide, desired gram weight range there is frequently an unreliable, faulty detection. The principle of using correction characteristic changes and improves this, so that the evaluating circuit following the receiver can have a corresponding correction characteristic, also a combination of several characteristic characteristics impressed on it, so as in this way to obtain over the desired gram weight range a readily evaluatable target characteristic for reliable detection deciding whether there is a separated recording medium, a multiple/double sheet or no sheet.

For multiple sheet detection the ideal target characteristic is a horizontal line without any gradient, so as to bring about a reliable detection with the maximum spacing from the air threshold or lower double sheet threshold. This applies over the entire gram weight range, which can be extended whilst taking account of galvanic separation and mechanical decoupling to a range of approximately 6000 g/m$^2$ without any learning process, which covers most of the existing flat object range or the paper and foil material range.

In a particularly advantageous development, it is also possible to have a learning process on a recording medium or on a separated, flat material in combination with the correction characteristic method in a device, in order to further extend the material spectrum to be detected.

In connection with the detection of labels covering a relatively narrow gram weight range of approximately 40 to 300 g/m$^2$, the specific correction characteristic must be such that there is a target characteristic with a linear course and maximum gradient of the corresponding lines.

For the correction characteristic method it must be established that there is a fundamental difference in connection with the formation of correction characteristics for multiple sheet detection and for label detection.

Also when taking account of these requirements concerning the correction characteristics, FIG. 8*a* shows an idealized example of curves in the correction characteristic method for multiple/double sheet detection.

In the Cartesian coordinate system is plotted on the abscissa the gram weight g/m$^2$, respectively the material causing damping, and on the ordinate the percentage signal output voltage $U_A$ of the exemplified course of a measuring value characteristic $MK_{DB}$ in connection with the correction characteristic method as the damping or attenuation constant.

The ideal target characteristic $ZK_i$ for the detection of single, missing or double sheets is a constant for the value of the single sheet with the gradient 0 (voltage swing: $H_{DB}$=0). The necessary correction characteristic $KK_{DB}$ is also shown for this example. It is clear from this that there is initially a transformation of the points of the measuring value characteristic MK in the downward direction of arrows P and then for increasing gram weights or higher damping materials an upward transformation of the values, in order to obtain the ideal target characteristic $ZK_i$ for single sheet detection or for the separated recording media.

Figure 8B:
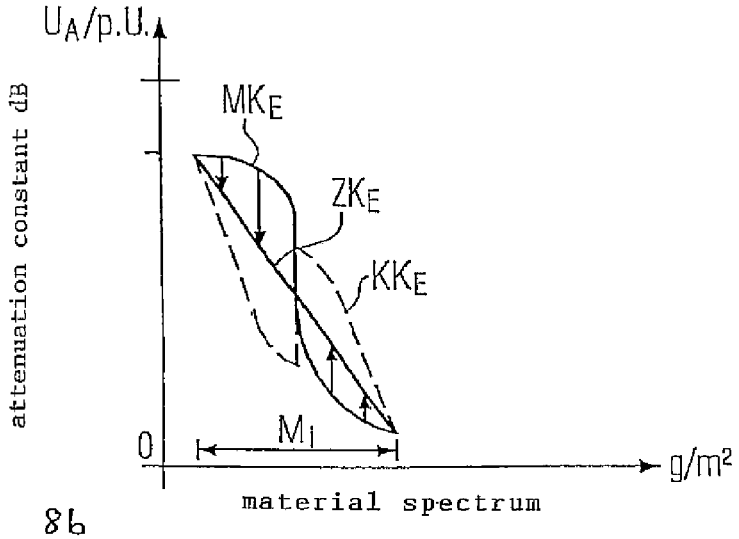
FIG. 8*b* A simplified view between measuring value characteristic, correction characteristic and target characteristic for detecting flat objects such as labels.
Figure 8C:
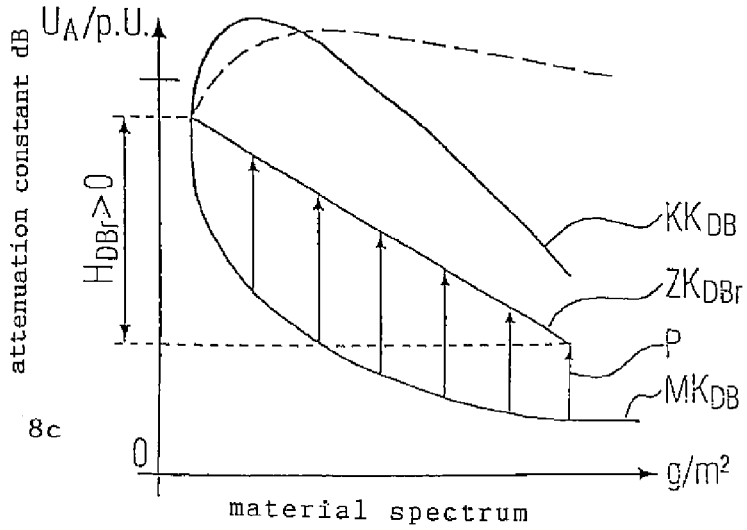
FIG. 8*c* A diagrammatic representation of a realistic course of the measuring value characteristic, correction characteristic and attainable target characteristic in the case of a double sheet.

The example of FIG. 8*b* shows corresponding paths of the characteristics for the correction characteristic method in connection with label detection and the detection of objects such as materials applied adhesively to the support material. The measuring value characteristic $MK_E$ is shown in exemplified manner in continuous line form. The ideal target characteristic $ZK_E$ is a line with a negative gradient or high voltage swing. The correction characteristic $KK_E$ necessary for the transformation is, for example, shown in broken line form and in this case has a discontinuity point at the intersection between measuring value characteristic $MK_E$ and target characteristic $ZK_E$. FIG. 8*c* diagrammatically shows the path of the characteristics according to the correction characteristic method for single or double sheet detection for a case in which, instead of the ideal target characteristic, a more realistic or practical target characteristic $ZK_{DBr}$ is obtained. Thus, the more realistic target characteristic $ZK_{DBr}$ has a swing $H_{DBr}$ greater than the ideal swing $H_{DB}$=0. In this case the measuring value characteristic $MK_{DB}$ plotted can be transformed by the impression of, for example, the correction characteristic $KK_D$B as the upper, continuous line, into the target characteristic $ZK_{DBr}$. The transformation is indicated by arrows P.

Using the corresponding correction characteristic method, the invention consequently permits a further widening of the material spectrum whilst at the same time improving the signal sensitivity and largely eliminating disturbing influences, without from the method standpoint it being necessary to have a learning step for the targeted detection of separated recording media.

It is also possible to combine both methods of correction characteristic for multiple sheet detection with respect to flat materials and for the detection of labels and similar materials.

According to a further development of the invention it is also possible to introduce a learning method in order to further extend the material spectrum to be detected, in that learning is combined with the correction characteristic method.

Figure 9:
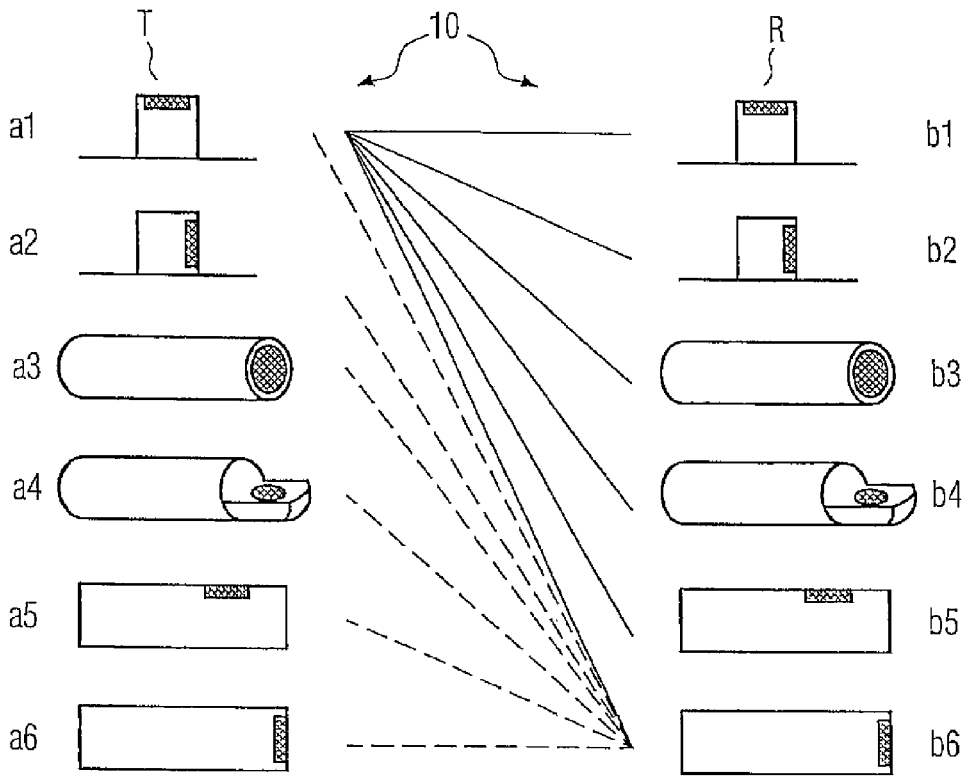
FIG. 9 An exemplified diagrammatic representation of different embodiments of sensors with cylindrical and parallelepipedic casings of supports for transducers, as well as their possible combinations with transmitter and receiver as a sensor device.

FIG. 9 shows in exemplified form various diagrammatically represented embodiments of the sensor device 10 with (a3, a4, a5, a6; b3, b4, b5, b6) and without (a1, a2; b1, b2) casing. The sensor devices 10 with and without a casing can be randomly combined. The sensor device 10 comprising transmitter T and receiver R need not have the same casing constructional shapes for each of these components, if such casings are provided. Cylindrical (a1-a4; b1-b4) and parallel-epipedic (a5, a6; b5, b6) casings are particularly suitable. Economic efficiency can be achieved through the complete omission of a casing for sensor devices 10. Then only the transducer has a transducer receptacle, which makes it possible to include the sensor device 10 or parts thereof in an equipment casing made available by printers such as, for example, office equipment in the form of scanners, printing units, copiers, as well as cash separators, voting and printing machines.

Particularly advantageous from the ease of installation standpoint within the production of sensor units is to mount the transmitter/transducer directly on a printed circuit board, which can take place in plane-parallel manner and also perpendicular to the circuit board plane.

Figure 10A:
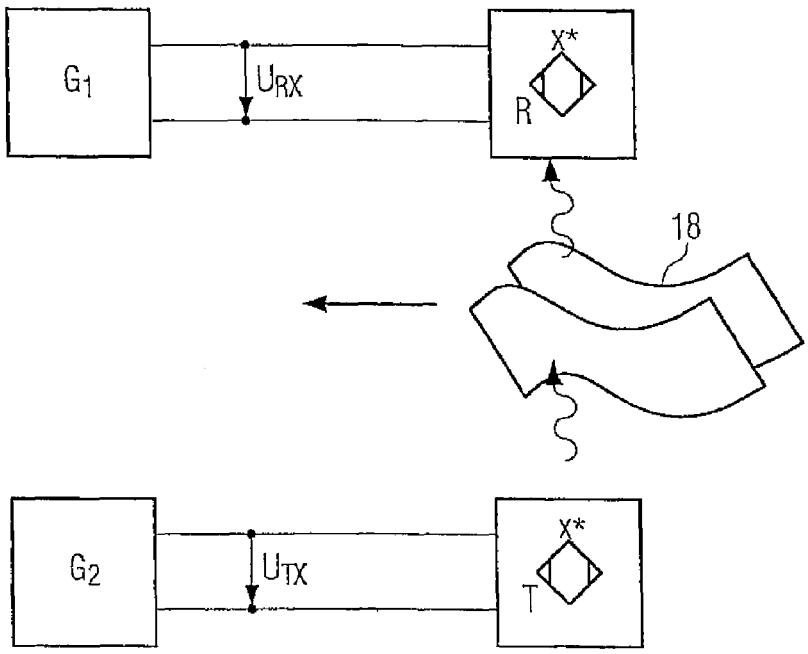
FIG. 10*a* A block diagram of a sensor device with two different voltage/current supply sources.
Figure 10B:
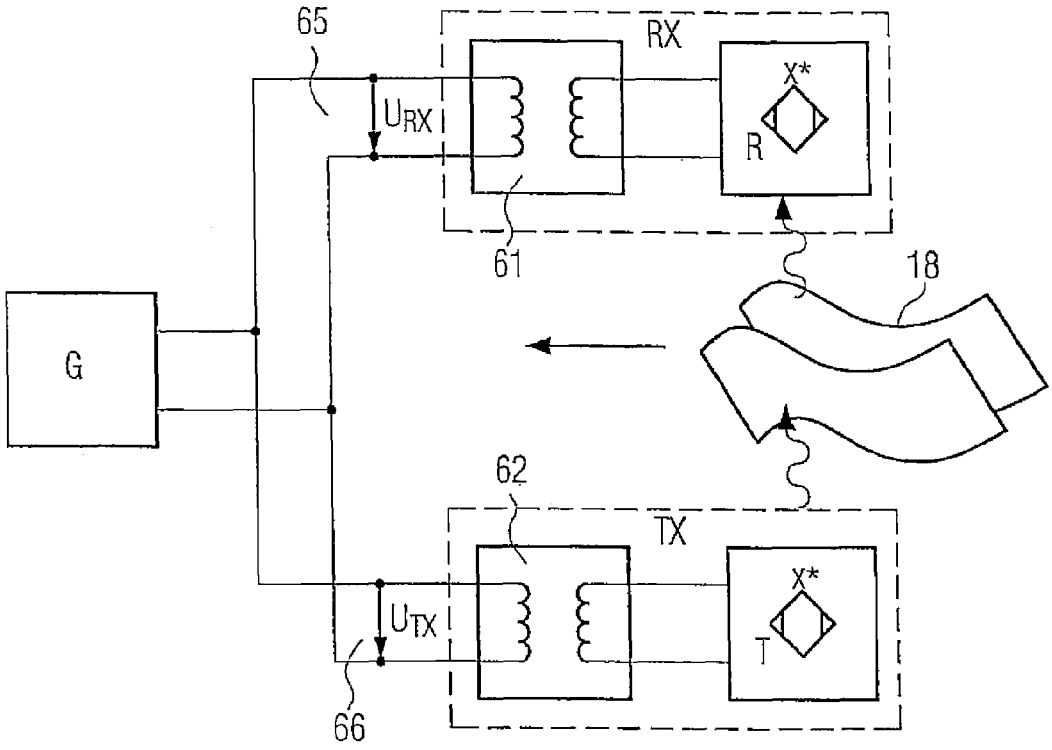
FIG. 10*b* An analogous example to FIG. 10*a*, but with the voltage/current supply from a single source.

FIGS. 10*a* and 10*b* show diagrammatically and in block diagram form a possibility of galvanic separation for the supply of transmitter T and receiver R. The same references designate the same objects and modules as in the preceding drawings.

The recording media 18 are passed for detection purposes between transmitter T and receiver R, which can operate optically, inductively or capacitively or have an ultrasonic basis.

In FIG. 10*a* galvanic separation is brought about in that receiver R has a separate power supply from a generator $G_1$ or power pack. Transmitter T is supplied by a completely separate generator $G_2$ or power pack. There are no signal lines between transmitter T and receiver R.

Unlike in the example according to FIG. 10*a*, the supply of the sensor device with transmitter T and receiver R according to FIG. 10*b* takes place by means of a single supply block G as generator or power pack.

The inventively necessary galvanic separation of transmitter T and receiver R is in this case brought about by at least one galvanic separating unit, for example, a transformer 61, in the supply branch 65. For transmitter T there is a separate galvanic separation by a transformer 62 in the other supply branch 66. Here again there are no signal lines between transmitter T and receiver R.

This makes it possible to ensure that, apart from the mechanical decoupling between transmitter T and receiver R, a galvanic separation is strictly maintained in order to extend the detection spectrum for recording media.

The invention claimed is:

1. Method for the contactless detection of laminated, flat objects, particularly sheet-like recording media, relative to separated single, multiple or missing sheets of recording media, the recording media intersecting a radiation path of at least one transmitter and an associated receiver of an ultrasonic sensor device and in which radiation transmitted by the recording media or radiation received in a case of a missing sheet by the receiver is received as a measuring signal, which is supplied to a following evaluation for generating a corresponding detection signal, at least the transmitting signal on the transmitter side is generated in a galvanically separated manner from the receiver by eliminating any voltage signal paths and any current signal paths between the transmitter and the receiver, and the transmitter and receiver are vibrationally decoupled from one another;

wherein at least one correction characteristic is supplied to the evaluation, and wherein the correction characteristic transforms a characteristic of an input voltage of the measuring signal from the receiver as a function of a gram weight or weight per unit area of the recording media to a target characteristic which, for sheet-like recording media, there is an almost linear characteristic or a characteristic approximated to an ideal characteristic of a separated single sheet as a target characteristic between an output voltage at an output of the evaluation and the gram weight or weight per unit area for generating the corresponding detection signal.

2. Method according to claim 1, wherein a signal-to-noise ratio is improved by means of the galvanic separation of the transmitter and the receiver, and wherein the characteristic of the input voltage of the measuring signal is transformed using the correction characteristic into the target characteristic over a wide gram weight or weight per unit area range, particularly between 8 and 6000 g/m$^2$ and also for simplex and duplex corrugated boards.

3. Method according to claim 1, particularly in sheet form, such as multilaminated materials adhesively applied to a base or support material, wherein at least one correction characteristic is supplied to the evaluation, and wherein the correction characteristic transforms a characteristic of an input voltage of the measuring signal from the receiver as a function of a gram weight or weight per unit area of the flat objects or recording media to a target characteristic in such a way that there is an almost linear characteristic with finite gradient, particularly a characteristic provided with a maximum gradient in the gram weight range to be detected, as an ideal target characteristic between an output voltage at an output of the evaluation and the gram weight or weight per unit area, for generating the corresponding detection signal.

4. Method according to claim 1, wherein the detection signal for separated single, missing or multiple sheets or stacked packaging materials is determined in continuous conveying operation of the flat objects or the recording media to be detected and/or during a teach-in process of the ultrasonic sensor device and is taken into account for detection in continuous conveying operation, particularly as a threshold value.

5. Method according to claim 1, wherein a mutual orientation of transmitter and the receiver, particularly their transducers, is performed by means of a given fastening base, particularly by means of the given printed circuit board.

6. Method according to claim 1, wherein the transmitting signal undergoes at least one frequency modulation.

7. Method according to claim 6, wherein tolerances and/or ageing effects of a transducer of the ultrasonic sensor device are corrected, more particularly automatically, by frequency modulation before and/or during operation.

8. Method according to claim 1, wherein the ultrasonic sensor device can be switched from pulsed operation to continuous operation by circuitry or in program-controlled manner at the transmitter and wherein a case of continuous operation phase jumps and/or short pauses of the transmitting signal are produced to avoid standing waves.

9. Method according to claim 1, wherein the transmitting signal is generated over at least one unidirectional measuring section.

10. Method according to claim 1, wherein several ultrasonic sensor devices of the same or a similar nature are signal-interlinked to obtain the detection signal.

11. Method according to claim 1, wherein the transmitter and the receiver have galvanically separated voltage supplies.

12. Method according to claim 1, further comprising supplying at least one correction characteristic to the evaluation, wherein the correction characteristic transforms a characteristic of an input voltage of the measuring signal from the receiver as a function of a gram weight or weight per unit area of the recording media to a target characteristic, and wherein the characteristic of the input voltage of the measuring signal is transformed using the correction characteristic into the target characteristic over a gram weight or weight per unit area range of between about 8 and about 6000 g/m$^2$.

13. Device for the contactless detection of laminated, flat objects, particularly sheet-like recording media, with respect to separated single, multiple or missing sheets of the recording media, with at least one ultrasonic sensor device having at least one transmitter and associated receiver, the recording media to be detected intersecting a radiation path between the transmitter and the receiver, the receiver receiving radiation transmitted by the recording media or radiation received in a case of a missing sheet as a measuring signal, with a downstream evaluating device, to which is supplied the measuring signal for generating a detection signal, wherein the transmitter is galvanically separated and vibrationally decoupled from the receiver of the ultrasonic sensor device, or at least the transmitting signal is generated in a galvanically separated manner decoupled from the receiver, wherein the galvanic separation is provided by eliminating any voltage signal paths or current signal paths between the transmitter and the receiver;

wherein at least one correction characteristic is supplied to the evaluating device, and wherein the correction characteristic transforms a characteristic of an input voltage of the measuring signal from the receiver as a function of a gram weight or weight per unit area of the recording media to a target characteristic which, for sheet-like recording media, there is an almost linear characteristic or a characteristic approximated to an ideal characteristic of a separated single sheet as a target characteristic between an output voltage at an output of the evaluation and the gram weight or weight per unit area for generating the corresponding detection signal.

14. Device according to claim 13, wherein separate power supplies are provided for the transmitter and the receiver.

15. Device according to claim 13, wherein the transmitter and the receiver are placed on separate supports, particularly spaced printed circuit boards, which are more particularly located on either side of a guidance gap for the recording media provided between the transmitter and the receiver.

16. Device according to claim 15, wherein the transmitter and the receiver are designed without a casing or with a casing, particularly a cylindrical or parallelepipedic casing, or with or without a casing with angled transducer casing and wherein construction forms of the transmitter and the receiver can be combined with one another.

17. Device according to claim 15, wherein the printed circuit board is connected in shape-stable manner with an adjacent module, particularly an equipment casing.

18. Device according to claim 15, wherein a connection side of the transmitter and/or the receiver is largely encapsulated and in particular electromagnetic encapsulated by means of a shielding can with respect to the support.

19. Device according to claim 13, wherein the transmitter and the receiver comprise ultrasonic transducers.

20. Device according to claim 19, wherein the transducers of the transmitter and/or receiver are directly mounted on a respective circuit board.

21. Device according to claim 19, wherein a shielding can for a transducer element and a coupling layer are provided in a positive manner in a transducer receptacle with a plane-parallel orientation to a particular support.

22. Device according to claim 21, wherein the transducer receptacle has an orienting device, particularly as a circumferential edge, for a substantially parallel orientation of the transducer with a plane of support.

23. Device according to claim 21, wherein for an orientation of the transducer with the support, particularly a printed circuit board, at a bottom of the shielding can are provided spacing studs with respect to the support.

24. Device according to claim 21, wherein there are detents, particularly with a back-grip with respect to a circuit board, for an orienting fixing of the transducer receptacle.

25. Device according to claim 21, wherein an elastomeric damping device surrounds the transducer receptacle relative to adjacent modules.

26. Device according to claim 19, wherein the transducers of the transmitter and/or the receiver are designed as plane-parallel or angled transducers with respect to a support and are oriented with respect to one another in a radiation axis.

27. Device according to claim 13, wherein a radiation axis between the transmitter and the receiver is oriented under an angle to a plane of the recording media to be detected.

28. Device according to claim 13, wherein a spacing between the transmitter and the receiver can be varied as a function of requirements and applications.

29. Device according to claim 13, wherein the evaluating device connected to the receiver is supplied with at least one correction characteristic in such a way that the correction characteristic transforms a characteristic of an input voltage of the measuring signal from the receiver as a function of a gram weight or weight per unit area of the recording media into the target characteristic in such a way that for recording media, such as laminated, flat objects, particularly in sheet form, such as paper, corrugated boards, foils, films, plates and similar flat materials and packages, it is possible to produce a linear characteristic or a characteristic approximated to an ideal single sheet characteristic in the form of a target characteristic between the output voltage at an output of evaluating device and the gram weight or weight per unit area for the detection of separated single, multiple or missing sheets.

30. Device according to claim 29, wherein the correction characteristics can be combined with one another.

31. Device according to claim 13, wherein the evaluating device connected to the receiver is supplied with at least one correction characteristic in such a way that the correction characteristic transforms a characteristic of an input voltage of the measuring signal from the receiver as a function of a gram weight or weight per unit area of the recording media into the target characteristic in such a way that for recording media with multilaminated materials adhesively applied to a base or support material and similar flat materials it is possible to produce an almost linear characteristic with a finite gradient, particularly with a maximum gradient in the gram weight range to be detected, as an ideal target characteristic or with a target characteristic approximated to said ideal target characteristic, between an output voltage at the output of the evaluation and the gram weight or weight per unit area, for detecting a presence, separation or absence of the multilaminated materials, such as labels.

32. Device according to claim 13, wherein the at least one ultrasonic sensor device for the recording media to be detected uses a teach-in step and wherein from this it is possible to determine a threshold value by means of a measuring value characteristic value present in the teach-in step or a value derived therefrom, for a separated single sheet or similar flat material for evaluating device.

33. Device according to claim 13, wherein a single power supply is provided for the transmitter and the receiver, and wherein there is a galvanic separation unit in at least one supply branch of the power supply for the transmitter or receiver for eliminating any voltage signal paths or current signal paths between the transmitter and the receiver.

34. Device according to claim 33, wherein there is a galvanic separation unit in each supply branch of the power supply for the transmitter and the receiver.

35. Device according to claim 33, wherein the galvanic separation unit comprises a transformer.

36. Device according to claim 13, wherein the transmitter and the receiver have galvanically separated voltage supplies.

37. Device according to claim 13, wherein at least one correction characteristic is supplied to the evaluating device, wherein the correction characteristic transforms a characteristic of an input voltage of the measuring signal from the receiver as a function of a gram weight or weight per unit area of the recording media to a target characteristic, and wherein the characteristic of the input voltage of the measuring signal is transformed using the correction characteristic into the target characteristic over a gram weight or weight per unit area range of between about 8 and about 6000 $g/m^2$.

* * * * *